United States Patent [19]

Montfort

[11] Patent Number: 4,932,142

[45] Date of Patent: Jun. 12, 1990

[54] DEVICE FOR ADJUSTING THE CONTROL OF THE FLEXION OF A SKI BOOT UPPER

[75] Inventor: Benoit Montfort, Annecy, France

[73] Assignee: Salomon S.A., Pringy, France

[21] Appl. No.: 307,717

[22] Filed: Feb. 8, 1989

[30] Foreign Application Priority Data

Feb. 8, 1988 [FR] France ..... 88 01436

[51] Int. Cl.[5] ..... A43B 5/04

[52] U.S. Cl. ..... 36/117; 36/121; 403/290

[58] Field of Search ..... 36/117–121; 403/289, 290, 297, 354; 24/704.1, 704.2, 337, 612

[56] References Cited

U.S. PATENT DOCUMENTS

| | | | |
|---|---|---|---|
| 4,169,297 | 10/1979 | Weihranch | 403/290 |
| 4,455,768 | 6/1984 | Salomon | 36/121 |
| 4,577,420 | 3/1986 | Petrini et al. | 36/117 |
| 4,653,205 | 3/1987 | Koch | 36/117 |

FOREIGN PATENT DOCUMENTS

| | | | |
|---|---|---|---|
| 172159 | 2/1986 | European Pat. Off. | 36/121 |
| 2480575 | 10/1981 | France . | |
| 2590129 | 5/1987 | France . | |
| 2604067 | 3/1988 | France | 36/117 |

*Primary Examiner*—James Kee Chi

*Attorney, Agent, or Firm*—Pollock, Vande Sande & Priddy

[57] ABSTRACT

A device for adjusting the control of flexion of a ski boot upper, in which a slide carries a maneuvering and locking lever constituted by an elastic element in the form of an omega which is articulated on the body of the slide by two coaxial end flanges. On of these flanges constitutes a locking catch and the body of the slide presents a ramp which cooperates with the lateral arm of the lever which bears the flange constituting a locking catch and which is shaped so as to cause, during pivoting movement of the lever, a movement of the lateral arm causing retraction of the locking catch.

11 Claims, 2 Drawing Sheets

DEVICE FOR ADJUSTING THE CONTROL OF THE FLEXION OF A SKI BOOT UPPER

FIELD OF THE INVENTION

The present invention relates to a device for adjusting the control of the flexion of a ski boot upper.

BACKGROUND OF THE INVENTION

Ski boots are already known whose upper, articulated on a bottom shell about a horizontal and transverse axis, comprises a front part or spoiler partially overlapping the bottom shell by its lower, front part. In a boot of this type, which is described in Patent Fr-A-2 590 129, the lower, front part of the spoiler comprises a transversely extending slot which forwardly defines an end part of the spoiler constituting a flexion piece. In this transverse slot is housed a slide tightly fitted between the two longitudinal edges of the slot and whose position is adjustable along the slot. This slide makes it possible to adjust, as desired, the control of the flexion of the articulated upper, depending on the position that the slide occupies in the slot.

In the ski boot described in the patent mentioned above, the slide is provided with at least one locking catch normally projecting laterally under the action of elastic return means in order to be able to engage in holes or notches provided in at least one of the edges of the slot in order to immobilize the slide in the desired position of adjustment. This catch, which is elastically urged towards its extended position, may be retracted inside the slide in order to allow displacement thereof, by action on a push element acting on a relatively complex connection mechanism.

SUMMARY OF THE INVENTION

The present invention relates to improvements to such a device, which considerably simplify the construction thereof and reduce its cost.

To that end, this device for adjusting the upper, this boot comprising a shell bottom partially covered by the lower, front part of a front part or spoiler constituting an element of the upper, comprises, in the lower, front part of the spoiler, a slot extending transversely and forwardly defining an end part of the spoiler constituting a flexion piece, and in this transverse slot, a slide tightly fitted between the two longitudinal edges of the slot and of which the longitudinal position is adjustable. The slide is provided with at least one locking catch normally projecting laterally, under the action of elastic return means, in order to be able to engage in holes or notches provided in at least one of the longitudinal edges of the slot, and means for maneuvering the slide by retraction of the locking catch inside the slide. The slide carries a maneuvering and locking lever constituted by an elastic element in the form of an omega which is articulated on the body of the slide by two end flanges, bent outwardly in the transverse direction, housed respectively in transverse holes in the body of the slide, at least one of the transversely bent end flanges constituting a locking catch adapted to project outside the hole in the body of the slide in which it is housed, and the body of the slide presents a ramp which cooperates with the lateral arm of the omega-shaped elastic lever which bears the flange constituting a locking catch and which is shaped so as to provoke, upon pivoting movement of the lever from a locking position, in which it lies flat on the body of the slide and the locking catch projects outwardly, towards an unlocking position in which the lever is substantially perpendicular to the plane of the slide body, a movement of tightening of the omega-shaped elastic lever, which movement causes the two lateral arms to move towards each other and the locking catch to retract inside the hole of the slide body.

BRIEF DESCRIPTION OF THE DRAWINGS

The invention will be more readily understood on reading the following description with reference to the accompanying drawings, in which.

DESCRIPTION OF PREFERRED EMBODIMENTS

Figure 1:
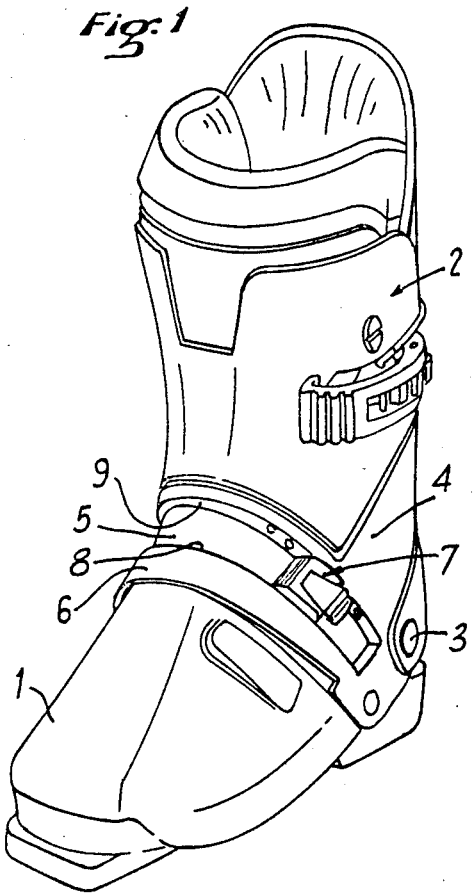
FIG. 1 is a perspective view of a ski boot provided with a device for adjusting the control of the flexion of the upper according to the invention.

Referring now to the drawings, FIG. 1 shows a ski boot comprising a bottom shell 1 on which is articulated an upper 2 adapted to pivot on the bottom shell 1 about a horizontal and transverse axis 3. The upper 2 comprises a front part or spoiler 4 which contains, in its front, lower part, a transverse slot 5 defining a front end part 6 constituting a flexion piece enveloping the bottom shell 1. In the transverse slot 5 is housed a mobile slide 7 which constitutes a spacer member between the two opposite longitudinal edges 8 and 9 of the slot 5. Consequently, the position that slide 7 occupies in the slot 5 determines the forward bending strength of the upper 2, and it is thus possible to control the flexion of this upper by adjusting the position of the slide 7 in the slot 5.

As may be seen more particularly in Figs. 2 to 6, the slide 7 is constituted by a piece of substantially parallelepipedic form, advantageously made of molded plastic material, which comprises a lower base 11 of rectangular form, of small thickness, which terminates on its longitudinal sides, i.e., extending in the direction of slot 5, in two upwardly extending edges 12, 13 of small height. These edges are engaged in corresponding inner grooves 8*a*, 9*a* provided, in the inner face of the spoiler, along edges 8, 9 to ensure guiding of the slide 7 in its longitudinal sliding movement.

In its central part, the base 11 is extended upwardly by a projection 14 which, seen in plan view, substantially has the form of a U open in the longitudinal direction. More particularly, the projection 14 comprises a transverse rib 14*a* and two parallel longitudinal ribs 14*b*, 14*c*, perpendicular to the web 14*a*, which each have a cross section in the form of a dovetail or isosceles trapezium. Each of the longitudinal ribs 14b, 14c is joined to the base 11 by the small base of the isosceles trapezium. Furthermore, seen in plan view, the longitudinal ribs 14b, 14c are inwardly defined by respective inner faces 14d, 14e which diverge with respect to each other starting from the transverse rib 14a. Consequently, the projection 14 defines, in its central part, a hollow 15 which, seen in plan view, has the form of an isosceles trapezium symmetrical with respect to the median longitudinal plane P of the slide, which is closed at the location of its small base, defined by the transverse rib 14a of the projection 14, and which is open at the location of its large base, i.e., the ends of the two longitudinal ribs 14b, 14c. In this hollow 15 is housed a maneuvering and locking lever 16 which is constituted by a wire bent substantially in the form of an omega. This lever 16 comprises a transverse web 16a which is extended by two lateral arms 16b, 16c which are parallel or slightly convergent in the state of rest and which terminate in respective coaxial end flanges 16d, 16e which are bent outwardly in the transverse direction. The maneuvering and locking lever 16 is made of an elastic material, such as a metal wire, giving it the properties of a spring. The two transverse end flanges 16d, 16e of the side arms 16b, 16c, which flanges define a transverse pivot axis x -- y of the lever 16, are engaged respectively in coaxial transverse holes 14f, 14g formed in the two longitudinal ribs 14b, 14c of the projection 14, in the vicinity of the transverse rib 14a.

Figure 2:
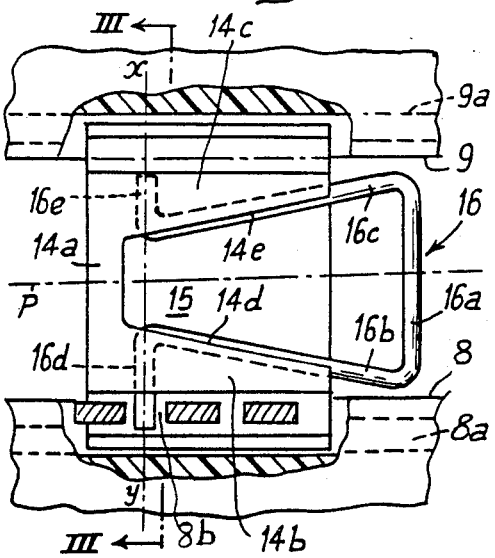
FIG. 2 is a plan view, partly in section, of the slide engaged in the slot of the spoiler, in locked position.
Figure 3:
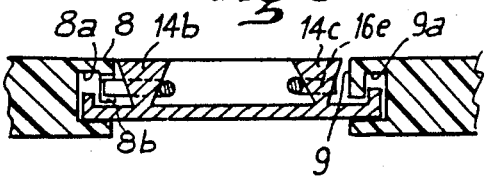
FIG. 3 is a section view along line III—III of FIG. 2.
Figure 4:
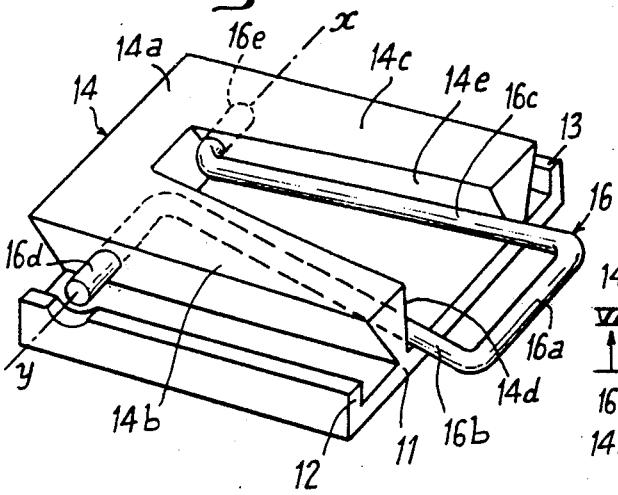
FIG. 4 is a pespective view of the slide in locked position

In the locked position shown in FIGS. 2 to 4, the maneuvering and locking lever 16 extends flat over the base 11, in the bottom of the hollow 15. In this position, the two lateral arms 16b, 16c of the lever 16 are applied against the inner faces 14d, 14e of the longitudinal ribs 14b, 14c of the projection 14, the end flange 16e is engaged in the corresponding hole of the longitudinal rib 14c without projecting outside this hole, while the opposite end flange 16d is engaged through the corresponding hole of the longitudinal rib 14b and projects outside this rib in order to ensure locking of the slide in the desired longitudinal position in the slot 5. In fact, FIGS. 2 and 3 show that this end flange 16d constitutes a locking catch elastically engaged and maintained in one of several holes 8b spaced at regular intervals from one another in the edge 8 of the slot 5 and opening out in the groove 8a.

Figure 6:
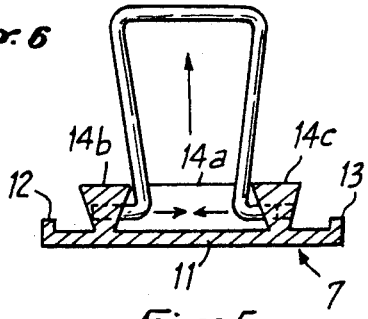
FIG. 6 is a section view along line VI—VI of FIG. 4.
Figure 5:
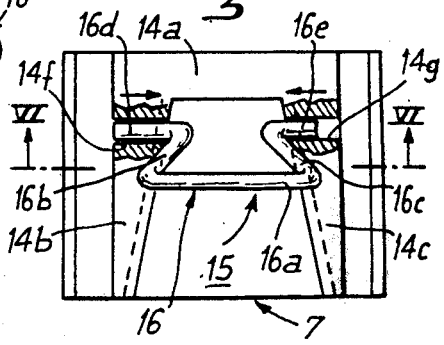
FIG. 5 is a plan view of the slide in unlocked position.

In order to unlock the slide 7, it suffices to pivot the lever 16 about its pivot axis x--y defined by the two bent end flanges 16d, 16e, and to move it into a position substantially perpendicular to the base 11, as shown in FIGS. 5 and 6. During this pivoting movement about axis x--y, the two lateral arms 16b, 16c of the lever 16 rub on the inner faces 14d, 14e of the longitudinal ribs 14b, 14c which constitute ramps for deformation of these arms. The convergent shape, seen in plan view, of the inner faces forming ramps 14d, 14e in the direction of the median plane P, leads to tightening of the two lateral arms 16b, 16c of the lever 16 and inward sliding of the bent end flanges 16d, 16e in their respective holes, as represented by the arrows in FIGS. 5 and 6. This causes the end flange 16d forming the locking catch to be totally disengaged from hole 8b and retracted inside the hole provided in the rib 14b, so that the slide 7 may be slid freely in the slot 5. The other end flange 16e also slides inwardly through part of the length of the hole in which it is housed without however leaving this hole, and it thus continues to constitute a pivot pin for the lever 16.

Once the slide 7 is placed in the desired position of adjustment, it suffices to pivot the maneuvering and locking lever 16 down flat on the base 11, in order to cause the bent end flange 16d forming locking catch to emerge, under the effect of the elastic resilience of the spring constituted by the lever 16. The locking catch 16d then engages in the corresponding hole 8b in the edge 8 of the slot 5, thus ensuring that the slide 7 is held in position.

In the embodiment of the invention which has been described hereinabove, the two longitudinal ribs 14b, 14c each have a transverse section in the form of an isosceles trapezium and are joined to the base 11 by their small bases. However, this embodiment is not limiting and, in particular, the outer faces of the two ribs 14b, 14c may be perpendicular to the base 11 or have any desired inclination. Furthermore, the inner face 14e of the rib 14c, which constitutes a bearing face for the lateral arm 16c of the lever 16 which bears the end flange 16e constituting the pivot pin, does not necessarily converge in the direction of the longitudinal median plane P but, on the contrary, may extend parallel to this plane. In that case, during the pivoting movement of the lever 16 in the direction of its unlocked position, the lateral arm 16c and the end flange 16e would not undergo any transverse displacement in the direction of this plane, but only the other lateral branch 16b would be deformed elastically by the ramp 14d.

According to another variant, the two end flanges 16d, 16e may each constitute a locking catch. In other words, holes similar to holes 8b may be made in the other edge 9 of the slot 5, the action of lever 7 then being symmetrical.

Figure 7:
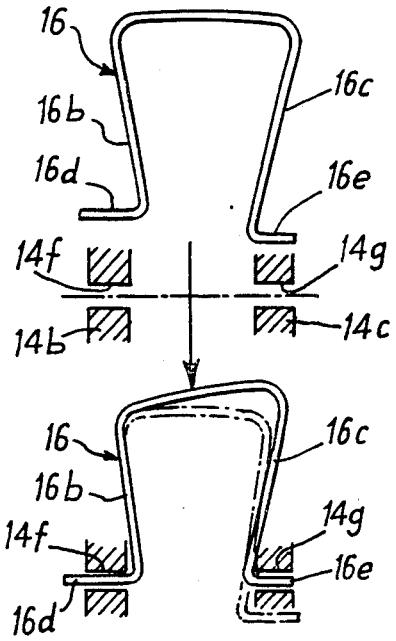
FIG. 7 is a schematic partial plan view of a variant embodiment of the assembly formed by the slide and the elastic maneuvering and locking lever, respectively before and after engagement of the end transverse flanges of the lever in the transverse holes in the slide.
Figure 8:
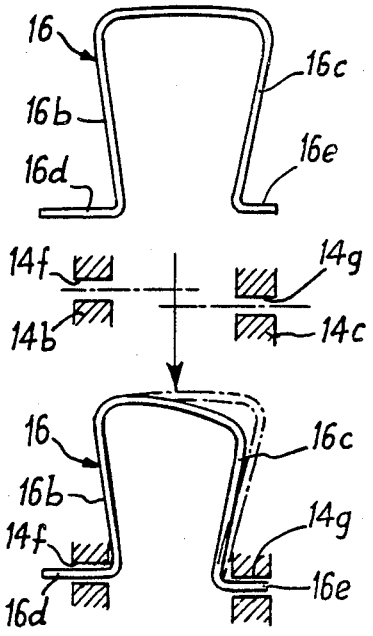
FIG. 8 is a schematic plan view of another variant embodiment of the assembly formed by the slide and the elastic maneuvering and locking lever, respectively before and after engagement of the end transverse flanges of the lever in the transverse holes in the slide.

In the embodiments shown in FIGS. 7 and 8, the two transverse end flanges 16d, 16e of the lateral arms 16b, 16c of the omega-shaped elastic lever 16 which define the transverse pivot axis of the lever 16 and the transverse holes 14f, 14g which are formed in the two longitudinal ribs 14b, 14c of the projection 14 of the slide 7, are disposed, with respect to one another, so as to provoke a slight pre-stress of the lever 16 in locked position, i.e., when this lever extends flat over the base 11 in the bottom of the hollow 15, as shown in FIGS. 2 and 3. This slight pre-stress promotes an automatic return of the lever 16 into its locked position.

In the embodiment shown in FIG. 7, the two holes 14f, 14g are coaxial, as in the embodiment described previously, but one of the lateral arms 16c of the lever 16 is longer than the other lateral arm 16b of this lever, so that the transverse end flanges 16d, 16e of the lever 16 are not coaxial when the elastic lever 16 is in the state of rest, i.e., relaxed, as shown in the upper part of FIG. 7. The engagement of the two transverse end flanges 16d, 16e respectively in the two coaxial holes 14f, 14g of the projection 14 causes deformation of the elastic lever 16 and more particularly a tightening of this lever, the two lateral arms 16b, 16c being brought towards each other, as shown in the lower part of FIG. 7. Consequently, the spring constituted by the omega-shaped lever 16 is slightly prestressed, which facilitates its automatic return into locked position.

In the embodiment shown in FIG. 8, the tightening of elastic omega-shaped lever 16, in locked position, is obtained by providing lateral arms 16b, 16c of the same length but by offsetting the two holes 14f, 14g with respect to each other so that these holes are no longer coaxial. Here again, the engagement of the transverse end flanges 16*d*, 16*e* in the respective holes 14*f*, 14*g* causes tightening of the elastic omega-shaped lever 16 and a pre-stress thereof, which pre-stress promotes the elastic return of the lever into locked position, i.e., flat on the base 11.

What is claimed is:

1. In a device for adjusting control of the flexion of an upper of a ski boot, said boot comprising a shell bottom partially covered by a lower front part of spoiler constituting an element of said upper, said adjusting device comprising, in said lower front part of said spoiler, a slot extending transversely and forwardly defining an end part of said spoiler constituting a flexion piece, and in said transverse slot, a longitudinally adjustable slide tightly fitted between two longitudinal edges of said slot, said slide being provided with at least one locking catch normally projecting laterally, under the action of elastic return means, for engagement in at least one hole provided in at least one longitudinal edge of said slot, the improvement wherein:

said slide carries a maneuvering and locking lever constituted by an elastic element in the form of an omega, said elastic element being articulated on a body of said slide by two end flanges bent outwardly in a transverse direction and housed respectively in transverse holes in said slide body, at least one of said flanges constituting a locking catch adapted to project outside in the hole in the body of the slide in which it is housed, and said slide body comprises a ramp which cooperates with a lateral arm of said lever which bears said at least one flange constituting said locking catch, said ramp being so shaped as to cause, upon pivoting movement of said lever from a locking position in which it lies flat on said slide body and in whch said locking catch projects outwardly, to an unlocking position in which said lever is substantially perpendicular to a plane of said slide body, movement of said lateral arm of said lever in the direction of the other lateral arm of said lever, said movement causing retraction of said locking catch inside said hole in said slide body.

2. The improvement according to claim 1, wherein said slide body comprises a flat base on which abuts said lever, in locked position, said base comprising first and second longitudinal ribs pierced respectively by transverse holes housing said two end flanges bent transversely and extending outwardly, said first rib being defined by an inner face constituting the ramp with which is in contact the lateral arm of said lever bearing an end flange constituting said locking catch, said second rib having an inner face constituting a bearing face for the other lateral arm bearing the other end flange forming a pivot axis, the inner face of said first rib, as seen perpendicularly to the plane of the base of said slide, being inclined from the outside in the direction of a longitudinal median plane of said slide, going from the transverse web of said lever towards the end flange forming said locking catch.

3. The improvement according to claim 2, wherein said inner face of said first rib is inclined with respect to said base at an angle less than 90°, in the direction of said longitudinal median plane of said slide.

4. The improvement according to claim 3, wherein said first rib, in transverse section, has the shape of an isosceles trapezium which is joined to said base by a small base of said first rib.

5. The improvement according to any one of claims 2 to 4, wherein the inner face of said second rib, constituting a bearing face for said second lateral arm of said lever, is inclined with respect to said base at an angle less than 90°, in the direction of said longitudinal median plane of said slide.

6. The improvement according to claim 5, wherein said second rib has a transverse section in the form of an isosceles trapezium and is joined to said base by a small base of said second rib.

7. The improvement according to any one of claims 2 to 4, wherein said first and second ribs are joined to each other, at ends of said first and second ribs containing said transverse holes receiving said end flanges of said lever, by a transverse rib so that said first and second ribs and said transverse rib jointly constitute a projection issuing from said base, in the form of a U open in the direction of a web of said lever, when the latter is flat on said base, in locked position.

8. The improvement according to any one of claims 1 to 4, wherein said transverse holes in said slide body are coaxial.

9. The improvement according to claim 8, wherein the lateral arms of said lever have the same length.

10. The improvement according to claim 8, wherein the lateral arms of said lever have different lengths, so that said lever is subjected to a slight pre-stress in locked position.

11. The improvement according to any one of claims 1 to 4, wherein the transverse holes in said slide body are offset with respect to one another and the lateral arms of said lever have the same length, so that said lever is subjected to a slight prestress in locked position.

* * * * *